US010243272B2

(12) United States Patent
Lee

(10) Patent No.: US 10,243,272 B2
(45) Date of Patent: Mar. 26, 2019

(54) ANTENNA DEVICE AND ANTENNA MODULE HAVING THE ANTENNA DEVICE

(71) Applicant: Getac Technology Corporation, Hsinchu County (TW)

(72) Inventor: Yen Ching Lee, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 396 days.

(21) Appl. No.: 15/139,467

(22) Filed: Apr. 27, 2016

(65) Prior Publication Data

US 2017/0317411 A1 Nov. 2, 2017

(51) Int. Cl.

| | |
|---|---|
| ***H01Q 1/36*** | (2006.01) |
| ***H01Q 11/08*** | (2006.01) |
| ***H01Q 1/22*** | (2006.01) |
| *H01Q 1/38* | (2006.01) |

(52) U.S. Cl.
CPC ..... *H01Q 11/08* (2013.01); *H01Q 1/2283* (2013.01); *H01Q 1/38* (2013.01)

(58) Field of Classification Search
CPC ..... H01Q 1/362; H01Q 1/243; H01Q 1/48
See application file for complete search history.

(56) References Cited

U.S. PATENT DOCUMENTS

2001/0045916 A1* 11/2001 Noro ..... H01Q 1/362 343/895
2006/0290590 A1* 12/2006 Takaoka ..... H01Q 1/362 343/895
2007/0194427 A1* 8/2007 Choi ..... H01L 23/3121 257/686

* cited by examiner

*Primary Examiner* — Jessica Han
*Assistant Examiner* — Jae K Kim
(74) *Attorney, Agent, or Firm* — Locke Lord LLP; Tim Tingkang Xia, Esq.

(57) ABSTRACT

An antenna device and an antenna module having the antenna device are provided and adapted to receive and transmit signals. The antenna device includes a first medium layer, a conductive ground hole, a first antenna circuit, a second antenna circuit and first conductive hole. The conductive ground hole penetrates the first medium layer. The first antenna circuit is disposed on a first surface of the first medium layer to surround the conductive ground hole. The second antenna circuit is disposed on a second surface of the first medium layer which is positioned distal to the first antenna circuit to surround the conductive ground hole. The first conductive hole penetrates the first medium layer. The first conductive hole has one end electrically connected to a second end of the first antenna circuit. The first conductive hole has the other end electrically connected to a first end of the second antenna circuit.

19 Claims, 8 Drawing Sheets

ANTENNA DEVICE AND ANTENNA MODULE HAVING THE ANTENNA DEVICE

BACKGROUND OF THE INVENTION

Field of the Invention

The present invention relates to antenna devices and antenna modules having the antenna devices and, more particularly, to an antenna device for use with an electronic device and an antenna module having the antenna device.

Description of the Prior Art

Antennas vary in form and type. Take the application of GPS as an example, the antenna of a GPS electronic device may be a patch antenna or a helix antenna. In general, the patch antennas are usually disadvantaged by limited bandwidth of the signals received, whereas the helix antennas operate at broader bandwidth. Therefore, the helix antennas are more suitable for receiving GPS signals than the patch antennas. However, the helix antennas are usually made of softer materials and therefore predisposed to deformation in shape and structure under an external force. For example, a helix antenna often deforms when collided or compressed under an external force while being mounted on an electronic device or being delivered upon completion of the mounting process. Upon its structural deformation, the helix antenna undergoes a change in its structural parameters, such as pitch and angle of inclination. The change, however small it might be, affects the quality of signal reception and transmission by the helix antenna.

A conventional antenna device essentially comprises a cylinder and a helix antenna. A channel is disposed on the circumferential surface of the cylinder and adapted to receive the helix antenna. Therefore, it is feasible to rotate the helix antenna by following the channel in order for the helix antenna to be mounted on the cylinder. Then, the cylinder is mounted on a substrate. Therefore, the cylinder serves as a support for the helix antenna to preclude structural deformation of the helix antenna. Due to its aforesaid features, the antenna device has to undergo an additional processing step during its manufacturing process in order for the helix antenna to be mounted on the cylinder, and in consequence its manufacturing process takes extra time and incurs extra labor costs.

Accordingly, it is imperative to not only prevent the helix antennas from undergoing any structural parameter change otherwise caused by deformation under an external force but also simplify the helix antenna manufacturing process.

SUMMARY OF THE INVENTION

In view of this, the present invention provides an antenna device and an antenna module having the antenna device to not only prevent helix antennas from undergoing any structural parameter change otherwise caused by deformation under an external force but also simplify the helix antenna manufacturing process.

In an embodiment, the antenna device comprises a first medium layer, conductive ground hole, first antenna circuit, second antenna circuit and first conductive hole. The conductive ground hole penetrates the first medium layer. The first antenna circuit is disposed on a first surface of the first medium layer to surround the conductive ground hole. The second antenna circuit is disposed on a second surface of the first medium layer which is positioned distal to the first antenna circuit to surround the conductive ground hole. The first conductive hole penetrates the first medium layer, has an end electrically connected to a second end of the first antenna circuit, and has another end electrically connected to a first end of the second antenna circuit.

In an embodiment, the first antenna circuit and the second antenna circuit overlap on a projection plane perpendicular to a direction in which the conductive ground hole extends.

In an embodiment, a first end of the first antenna circuit and the first end of the second antenna circuit are dislocated from each other.

In an embodiment, the first conductive hole and the conductive ground hole are parallel to each other.

In an embodiment, the first antenna circuit, the first conductive hole and the second antenna circuit together form a pseudo helical structure.

In an embodiment, the first antenna circuit is of the same length as the second antenna circuit. In another embodiment, the first antenna circuit is of a larger length than the second antenna circuit.

In an embodiment, the antenna device further comprises a base medium layer, signal contact, ground contact and base conductive hole. The base medium layer is disposed on the first surface of the first medium layer, with the first antenna circuit sandwiched between the first medium layer and the base medium layer, wherein the conductive ground hole penetrates the base medium layer. The signal contact and the ground contact are disposed on a surface of the base medium layer which is positioned distal to the first medium layer, wherein the conductive ground hole has an end electrically connected to the ground contact. The base conductive hole penetrates the base medium layer, has an end electrically connected to the signal contact, and has another end electrically connected to a first end of the first antenna circuit.

In an embodiment, another end of the conductive ground hole faces away from the ground contact to function as an open end. A second end of the second antenna circuit functions as an open end.

In an embodiment, the antenna device further comprises a second medium layer, a third antenna circuit and a second conductive hole. The second medium layer is disposed on the second surface of the first medium layer, with the second antenna circuit sandwiched between the first medium layer and the second medium layer, wherein the conductive ground hole penetrates the second medium layer. The third antenna circuit is disposed on a surface of the second medium layer which is positioned distal to the second antenna circuit to surround the conductive ground hole. The second conductive hole penetrates the second medium layer, has an end electrically connected to a second end of the second antenna circuit, and has another end electrically connected to a first end of the third antenna circuit.

In an embodiment, the antenna module comprises a substrate, a signal output circuit, a substrate signal contact, a substrate ground contact and the antenna device. The signal output circuit is disposed on the substrate. The substrate signal contact and the substrate ground contact are disposed on the substrate and electrically connected to the signal output circuit. The antenna device is disposed on the substrate, wherein the first antenna circuit is electrically connected to the substrate signal contact, and the conductive ground hole is electrically connected to the substrate ground contact.

In conclusion, according to the embodiments of the present invention, an antenna device and an antenna module having the antenna device to not only prevent a helical antenna circuit from undergoing any structural parameter change otherwise caused by deformation under an external force but also enable the antenna circuit to be directly formed on a medium layer by a circuit manufacturing technique of a printed circuit board (PCB), so as to simplify the manufacturing process, enhance the production efficiency, speed up the manufacturing process, and cut labor costs.

The detailed features and advantages of the present invention are illustrated with embodiments and described below to enable persons skilled in the art to gain insight into the technical solution of the present invention and implement it accordingly. Persons skilled in the art can easily understand the related objectives and advantages of the present invention by making reference to the drawings, claims and specification of the present invention.

DETAILED DESCRIPTION OF THE EMBODIMENTS

Figure 1A:
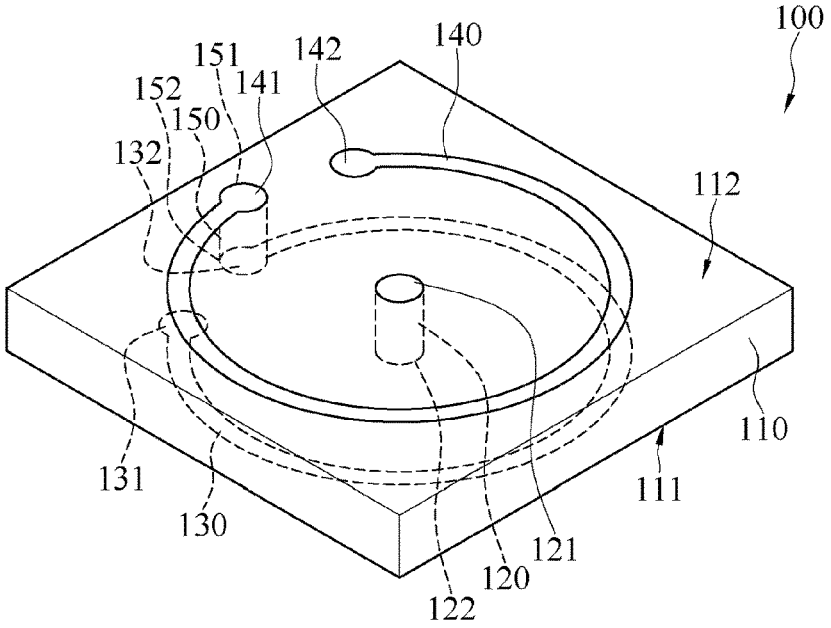
FIG. 1A is a schematic view of an antenna device from a specific angle of view according to the first embodiment of the present invention.
Figure 1B:
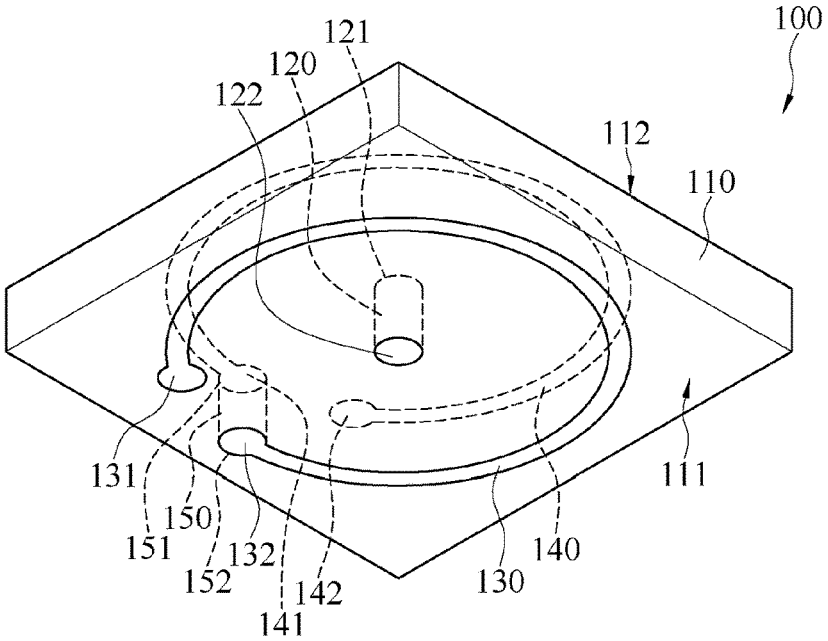
FIG. 1B is a schematic view of the antenna device from another angle of view according to the first embodiment of the present invention.

Referring to FIG. 1A and FIG. 1B, FIG. 1A is a schematic view of an antenna device 100 from a specific angle of view according to the first embodiment of the present invention, and FIG. 1B is a schematic view of the antenna device 100 from another angle of view according to the first embodiment of the present invention. In this embodiment, the antenna device 100 is disposed in an electronic device, such as a GPS navigator, and adapted to receive and transmit a GPS signal, but the present invention is not limited thereto. The antenna device 100 comprises a first medium layer 110, a conductive ground hole 120, a first antenna circuit 130, a second antenna circuit 140 and a first conductive hole 150. The first medium layer 110 is an insulator and is made of a material which a substrate of a printed circuit board is made of. The first medium layer 110 has a first surface 111 and a second surface 112 which are opposite and parallel to each other. The first medium layer 110 has a thickness (i.e., the distance between the first surface 111 and the second surface 112) which is adjusted as needed rather than restricted by the drawings. The conductive ground hole 120 penetrates the first medium layer 110 and therefore is exposed from the first surface 111 and the second surface 112. The conductive ground hole 120 extends in a direction perpendicular to the first surface 111 and the second surface 112. The conductive ground hole 120 comprises a top end 121 and a bottom end 122 which are opposite to each other. The top end 121 functions as the open end attributed to the conductive ground hole 120 disposing on the second surface 112. The bottom end 122 functions as the open end attributed to the conductive ground hole 120 disposing on the first surface 111. A conductive circuit is disposed in the conductive ground hole 120. The conductive circuit is formed on the wall of the conductive ground hole 120. The conductive circuit extends from the top end 121 to the bottom end 122. The conductive circuit is equivalent to the earth wire of the antenna device 100.

Referring to FIG. 1B, the first antenna circuit 130 is disposed on the first surface 111 of the first medium layer 110. The first antenna circuit 130 surrounds the conductive ground hole 120 by circling around an axis defined by and between the top end 121 and the bottom end 122 of the conductive ground hole 120. The first antenna circuit 130 comprises a first end 131 and a second end 132. The first end 131 and the second end 132 are not connected; hence, the first end 131 and the second end 132 are separated by a predetermined distance. Therefore, the annular path of the first antenna circuit 130 approximates a circle, as the annular path of the first antenna circuit 130 starts from the first end 131 and ends at the second end 132.

Referring to FIG. 1A, the second antenna circuit 140 is disposed on the second surface 112 of the first medium layer 110 and positioned distal to the first antenna circuit 130. Likewise, the second antenna circuit 140 surrounds the conductive ground hole 120 by circling around the axis of the conductive ground hole 120. The second antenna circuit 140 comprises a first end 141 and a second end 142. The first end 141 and the second end 142 are not connected; hence, the first end 141 and the second end 142 are separated by a predetermined distance. Therefore, the annular path of the second antenna circuit 140 approximates a circle, as the annular path of the second antenna circuit 140 starts from the first end 141 and ends at the second end 142. The first antenna circuit 130 and the second antenna circuit 140 are formed on the first surface 111 and the second surface 112, respectively, by a circuit manufacturing technique of a printed circuit board, but the present invention is not limited thereto.

In this embodiment, the first antenna circuit 130 is of the same length as the second antenna circuit 140, whereas both the first antenna circuit 130 and the second antenna circuit 140 are arcuate; hence, the length of the first antenna circuit 130 and the second antenna circuit 140 is equivalent to their arc. In another embodiment, both the first antenna circuit 130 and the second antenna circuit 140 are of the other geometric shapes, such as rectangular, elliptical, or triangular.

The first conductive hole 150 penetrates the first medium layer 110 and therefore is exposed from the first surface 111 and the second surface 112. The first conductive hole 150 extends in the direction perpendicular to the first surface 111 and the second surface 112. The first conductive hole 150 comprises a top end 151 and a bottom end 152 which are opposite to each other. The top end 151 functions as the open end attributed to the first conductive hole 150 disposing on the second surface 112. The bottom end 152 functions as the open end attributed to the first conductive hole 150 disposing on the first surface 111. A conductive circuit is disposed in the first conductive hole 150. The conductive circuit is formed on the wall of the first conductive hole 150. The conductive circuit extends from the top end 151 to the bottom end 152. The first conductive hole 150 has an end electrically connected to the second end 132 of the first antenna circuit 130. The first conductive hole 150 has the other end electrically connected to the first end 141 of the second antenna circuit 140. An end of the conductive circuit of the first conductive hole 150 extends to the bottom end 152 and connects with the second end 132 of the first antenna circuit 130. Another end of the conductive circuit of the first conductive hole 150 extends to the top end 151 and connects with the first end 141 of the second antenna circuit 140.

The first end 131 of the first antenna circuit 130 is a feed end for signals, whereas the bottom end 122 of the conductive ground hole 120 is a ground end. Therefore, when the antenna device 100 is mounted on an electronic device, the first end 131 of the first antenna circuit 130 is electrically connected to a related circuit or component for receiving a signal, whereas the bottom end 122 of the conductive ground hole 120 is electrically connected to a related circuit or component for grounding. Both the second end 142 of the second antenna circuit 140 and the top end 121 of the conductive ground hole 120 are open ends whereby the second end 142 of the second antenna circuit 140 and the top end 121 of the conductive ground hole 120 are no longer electrically connected to the other circuits or components. In another embodiment, the earth wire circuit and signal circuit substitute for each other; hence, the bottom end 122 of the conductive ground hole 120 becomes a signal feed end and gets electrically connected to a related circuit or component for receiving a signal, whereas the first end 131 of the first antenna circuit 130 becomes a ground end and gets electrically connected to a related circuit or component for grounding.

Figure 1C:
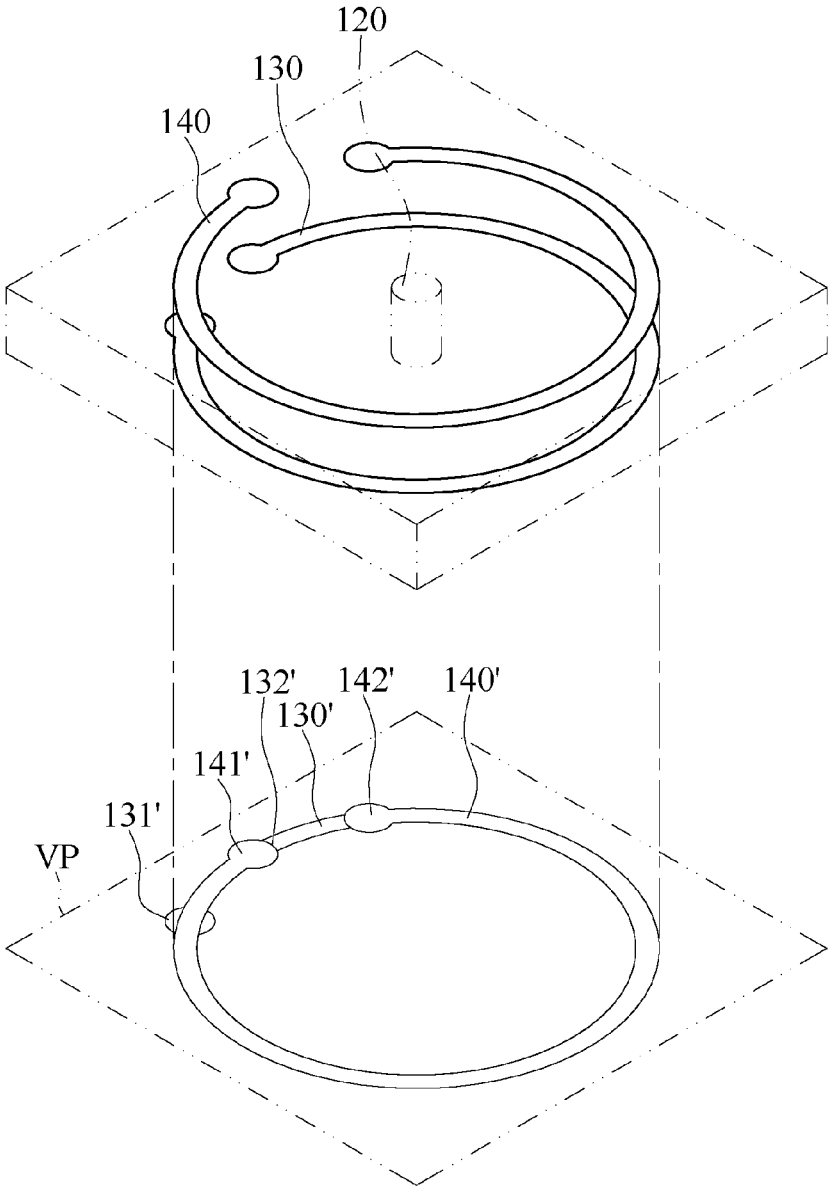
FIG. 1C is a schematic view of a first antenna circuit and a second antenna circuit which are projected on a virtual projection plane according to the first embodiment of the present invention.

Referring to FIG. 1C, FIG. 1C is a schematic view of the first antenna circuit 130 and the second antenna circuit 140 which are projected on a virtual projection plane VP according to the first embodiment of the present invention. The first antenna circuit 130 and the second antenna circuit 140 overlap in an axial direction, as projections of the first antenna circuit 130 and the second antenna circuit 140 overlap on the virtual projection plane VP perpendicular to the direction in which the conductive ground hole 120 extends. Referring to FIG. 1C, the first antenna circuit 130 is projected, in the direction which the conductive ground hole 120 extends, onto the virtual projection plane VP so as to form a first antenna circuit projection 130' on the virtual projection plane VP, whereas the second antenna circuit 140 is projected, in the direction which the conductive ground hole 120 extends, onto the virtual projection plane VP so as to form a second antenna circuit projection 140' on the virtual projection plane VP. The first antenna circuit projection 130' and the second antenna circuit projection 140' overlap. The first antenna circuit projection 130' and the second antenna circuit projection 140' form a complete circle on the virtual projection plane VP. Moreover, the first end 131 of the first antenna circuit 130 and the first end 141 of the second antenna circuit 140 are dislocated from each other. Referring to FIG. 1C, the first end 131 and the second end 132 of the first antenna circuit 130 are projected, in the direction which the conductive ground hole 120 extends, onto the virtual projection plane VP so as to form a first end projection 131' and a second end projection 132' on the virtual projection plane VP, respectively, whereas the first end 141 and the second end 142 of the second antenna circuit 140 are projected, in the direction which the conductive ground hole 120 extends, onto the virtual projection plane VP so as to form a first end projection 141' and a second end projection 142' on the virtual projection plane VP, respectively. The first end projection 131' and the first end projection 141' are dislocated from each other and therefore do not overlap, whereas the second end projection 132' and the first end projection 141' overlap.

Referring to FIG. 1A and FIG. 1B, in this embodiment, the first conductive hole 150 and the conductive ground hole 120 are parallel to each other. The extension directions or axes of the first conductive hole 150 and the conductive ground hole 120 are parallel to each other. The first antenna circuit 130, the first conductive hole 150 and the second antenna circuit 140 together form a pseudo helical structure; that is, a three-dimensional structure similar to a helix antenna. Therefore, in this embodiment, a three-dimensional structure of the helix antenna comprises stacked antenna circuits and trans-layer conductive holes. Therefore, the antenna device 100 receives and transmits signals as well as the helix antenna does. In this embodiment, the first antenna circuit 130 and the second antenna circuit 140 each run a circle, and therefore the antenna device 100 is analogous to a helix antenna which runs two circles.

Figure 2:
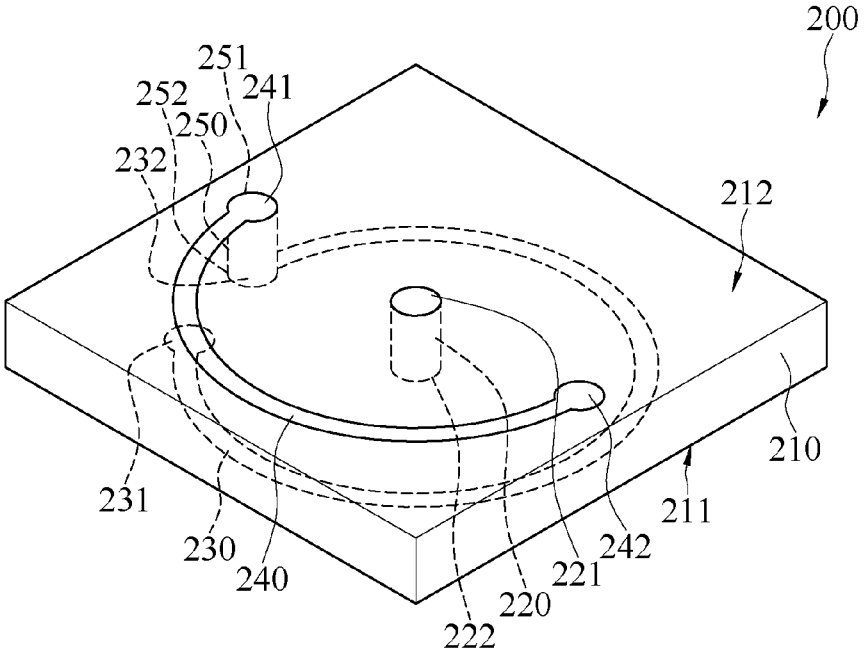
FIG. 2 is a schematic view of an antenna device according to the second embodiment of the present invention.

Referring to FIG. 2, FIG. 2 is a schematic view of an antenna device 200 according to the second embodiment of the present invention. The antenna device 200 comprises a first medium layer 210, conductive ground hole 220, first antenna circuit 230, second antenna circuit 240 and first conductive hole 250. The first medium layer 210 comprises a first surface 211 and a second surface 212 which are opposite to each other. The conductive ground hole 220 and the first conductive hole 250 each penetrate the first medium layer 210. The conductive ground hole 220 comprises a top end 221 and a bottom end 222 which are opposite to each other. The first conductive hole 250 comprises a top end 251 and a bottom end 252 which are opposite to each other. The first antenna circuit 230 is disposed on the first surface 211 to surround the conductive ground hole 220. The first antenna circuit 230 comprises a first end 231 and a second end 232. The second end 232 is electrically connected to the bottom end 252 of the first conductive hole 250. The second antenna circuit 240 is disposed on the second surface 212 to surround the conductive ground hole 220. The second antenna circuit 240 comprises a first end 241 and a second end 242. The first end 241 is electrically connected to the top end 251 of the first conductive hole 250.

The first antenna circuit 230 and the second antenna circuit 240 overlap on a projection plane perpendicular to the direction in which the conductive ground hole 220 extends. The first end 231 of the first antenna circuit 230 and the first end 241 of the second antenna circuit 240 are dislocated from each other. In this embodiment, the annular path of the first antenna circuit 230 approximates a circle, whereas the annular path of the second antenna circuit 240 approximates a semicircle. Therefore, the first antenna circuit 230 is of a larger length than the second antenna circuit 240. The first antenna circuit 230, the first conductive hole 250 and the second antenna circuit 240 together form a pseudo helical structure. In this embodiment, the antenna device 200 is analogous to a helix antenna which runs one and a half circles.

Figure 3A:
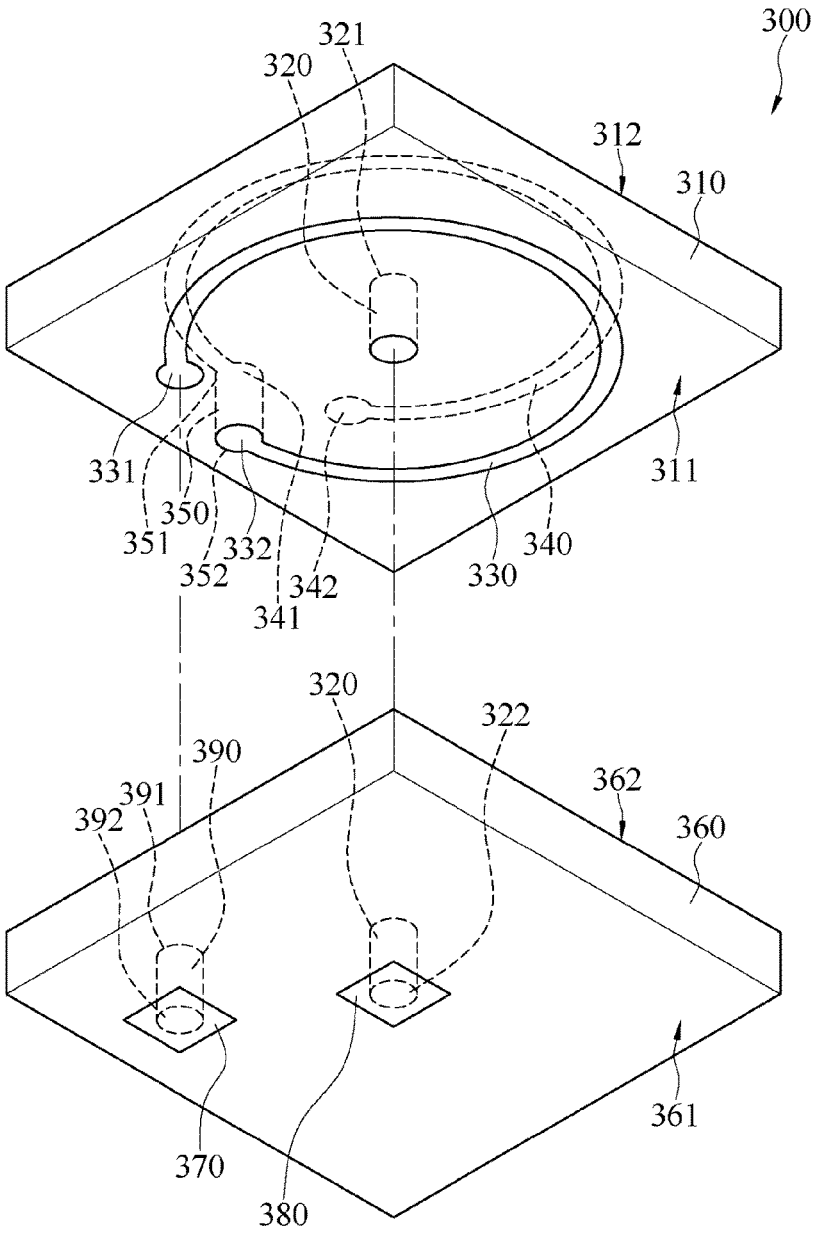
FIG. 3A is an exploded view of an antenna device according to the third embodiment of the present invention.
Figure 3B:
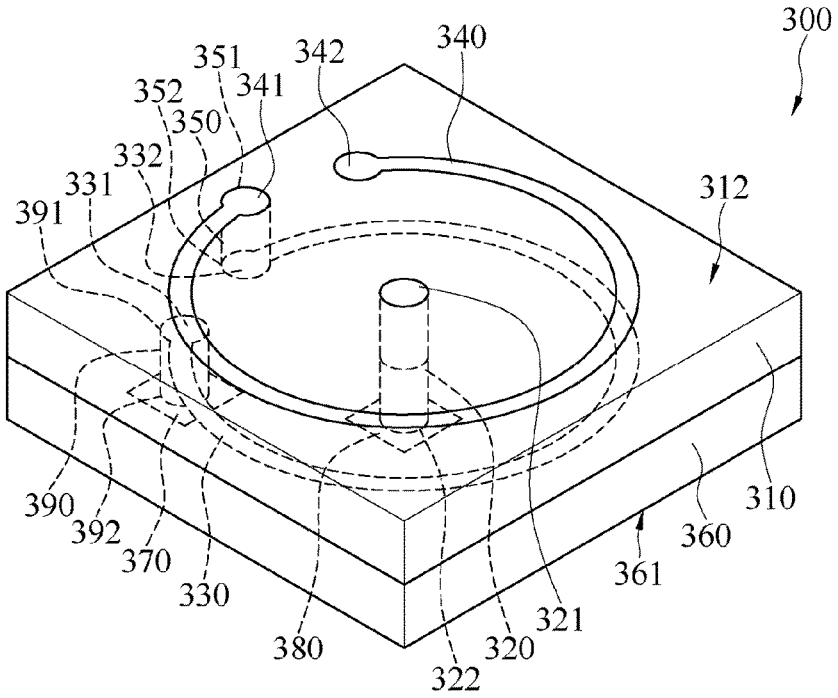
FIG. 3B is a schematic view of the antenna device according to the third embodiment of the present invention.

Referring to FIG. 3A and FIG. 3B, FIG. 3A is an exploded view of an antenna device 300 according to the third embodiment of the present invention, and FIG. 3B is a schematic view of the antenna device 300 according to the third embodiment of the present invention. The antenna device 300 comprises a first medium layer 310, conductive ground hole 320, first antenna circuit 330, second antenna circuit 340 and first conductive hole 350. In this embodiment, the antenna device 300 further comprises a base medium layer 360, signal contact 370, ground contact 380 and base conductive hole 390. The first medium layer 310 comprises a first surface 311 and a second surface 312 which are opposite to each other. The conductive ground hole 320 and the first conductive hole 350 each penetrate the first medium layer 310. The first antenna circuit 330 is disposed on the first surface 311 to surround the conductive ground hole 320. The first antenna circuit 330 comprises a first end 331 and a second end 332. The second end 332 is electrically connected to a bottom end 352 of the first conductive hole 350. The second antenna circuit 340 is disposed on the second surface 312 to surround the conductive ground hole 320. The second antenna circuit 340 comprises a first end 341 and a second end 342. The first end 341 is electrically connected to a top end 351 of the first conductive hole 350. The base medium layer 360 is disposed on one side of the first surface 311 of the first medium layer 310. The first antenna circuit 330 disposed on the first surface 311 is sandwiched between the first medium layer 310 and the base medium layer 360. The base medium layer 360 comprises a first surface 361 and a second surface 362 which are opposite and parallel to each other. The first antenna circuit 330 is sandwiched between the first surface 311 of the first medium layer 310 and the second surface 362 of the base medium layer 360.

In this embodiment, the conductive ground hole 320 penetrates the base medium layer 360. Therefore, the conductive ground hole 320 extends from the second surface 312 of the first medium layer 310 to the first surface 361 of the base medium layer 360. The extension direction or axis of the conductive ground hole 320 is perpendicular to the second surface 312 and the first surface 361. Therefore, a top end 321 of the conductive ground hole 320 is disposed on the second surface 312 of the first medium layer 310, whereas a bottom end 322 of the conductive ground hole 320 is disposed on the first surface 361 of the base medium layer 360. The base conductive hole 390 penetrates the base medium layer 360. The axis of the base conductive hole 390 is perpendicular to the first surface 361 and the second surface 362 of the base medium layer 360. The base conductive hole 390 comprises a top end 391 and a bottom end 392 which are opposite to each other. The top end 391 is disposed on the second surface 362 of the base medium layer 360. The bottom end 392 is disposed on the first surface 361 of the base medium layer 360. A conductive circuit which extends from the top end 391 to the bottom end 392 is disposed on the wall of the base conductive hole 390.

A signal contact 370 and a ground contact 380 are disposed on the first surface 361 of the base medium layer 360, positioned distal to the first medium layer 310, and spaced apart from each other. The bottom end 322 of the conductive ground hole 320 is electrically connected to the ground contact 380, whereas the bottom end 392 of the base conductive hole 390 is electrically connected to the signal contact 370. Moreover, the top end 391 of the base conductive hole 390 is electrically connected to the first end 331 of the first antenna circuit 330. In this embodiment, the signal contact 370 and the ground contact 380 are each a bonding pad for use in carrying out a surface mount technique (SMT) process. Therefore, with the signal contact 370 and the ground contact 380, it is practicable for the antenna device 300 to be mounted quickly on a related substrate by the SMT process.

Figure 4:
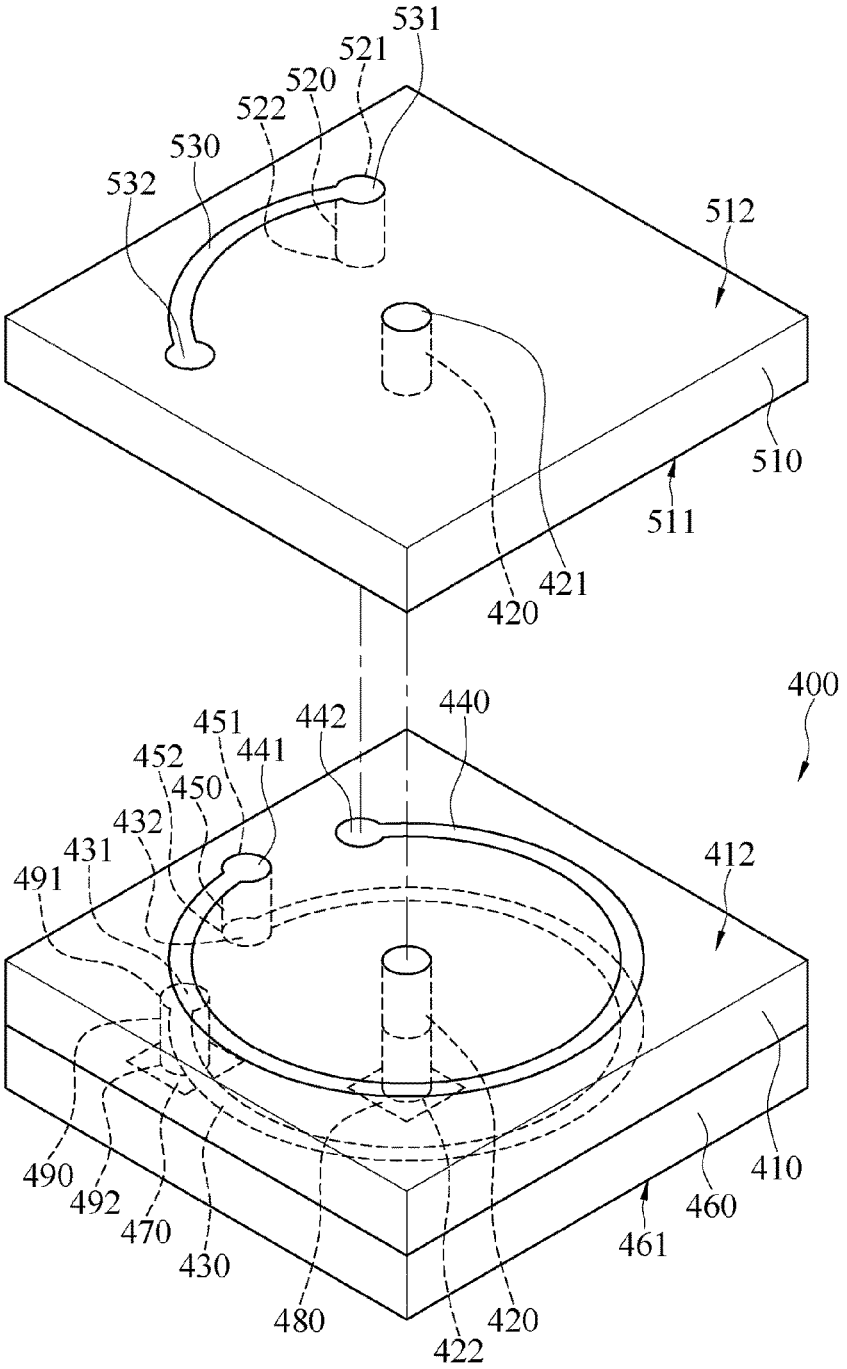
FIG. 4 is a schematic view of an antenna device according to the fourth embodiment of the present invention.

Referring to FIG. 4, FIG. 4 is a schematic view of an antenna device 400 according to the fourth embodiment of the present invention. The antenna device 400 comprises a first medium layer 410, conductive ground hole 420, first antenna circuit 430, second antenna circuit 440, the first conductive hole 450, base medium layer 460, signal contact 470, ground contact 480 and base conductive hole 490. The antenna device 400 further comprises a second medium layer 510, second conductive hole 520 and third antenna circuit 530. The first medium layer 410 comprises a first surface (not shown) and a second surface 412 which are opposite to each other. The first conductive hole 450 penetrates the first medium layer 410. The first antenna circuit 430 is disposed on the first surface of the first medium layer 410. The first antenna circuit 430 is sandwiched between the first medium layer 410 and the base medium layer 460. A second end 432 of the first antenna circuit 430 is electrically connected to a bottom end 452 of the first conductive hole 450. The second antenna circuit 440 is disposed on the second surface 412 of the first medium layer 410. The first end 441 of the second antenna circuit 440 is electrically connected to a top end 451 of the first conductive hole 450.

The second medium layer 510 comprises a first surface 511 and a second surface 512 which are opposite and parallel to each other. The second medium layer 510 is disposed on the second surface 412 of the first medium layer 410. The second antenna circuit 440 is sandwiched between the first surface 511 of the second medium layer 510 and the second surface 412 of the first medium layer 410. The second conductive hole 520 penetrates the second medium layer 510. The second conductive hole 520 comprises a top end 521 and a bottom end 522. The top end 521 of the second conductive hole 520 is disposed on the second surface 512. The bottom end 522 of the second conductive hole 520 is disposed on the first surface 511. A second end 442 of the second antenna circuit 440 is electrically connected to the bottom end 522 of the second conductive hole 520. The third antenna circuit 530 is disposed on the second surface 512 of the second medium layer 510 which is positioned distal to the second antenna circuit 440. The third antenna circuit 530 comprises a first end 531 and a second end 532. The first end 531 of the third antenna circuit 530 is electrically connected to the top end 521 of the second conductive hole 520. The second end 532 of the third antenna circuit 530 is an open end.

The conductive ground hole 420 vertically penetrates the second medium layer 510, the first medium layer 410 and the base medium layer 460. Therefore, the conductive ground hole 420 extends from the second surface 512 of the second medium layer 510 to a first surface 461 of the base medium layer 460. Therefore, the top end 421 of the conductive ground hole 420 is disposed on the second surface 512 of the second medium layer 510, whereas a bottom end 422 of the conductive ground hole 420 is disposed on the first surface 461 of the base medium layer 460. The base conductive hole 490 penetrates the base medium layer 460. A top end 491 of the base conductive hole 490 is electrically connected to a first end 431 of the first antenna circuit 430. The signal contact 470 and the ground contact 480 are disposed on the first surface 461 of the base medium layer 460 which is positioned distal to the first medium layer 410. The bottom end 422 of the conductive ground hole 420 is electrically connected to the ground contact 480. A bottom end 492 of the base conductive hole 490 is electrically connected to the signal contact 470.

In this embodiment, the annular path of the first antenna circuit 430 approximates a circle, whereas the annular path of the second antenna circuit 440 also approximates a circle, but the annular path of the third antenna circuit 530 runs a fourth of a circle. Therefore, the length of the first antenna circuit 430 substantially equals the length of the second antenna circuit 440, but both the first antenna circuit 430 and the second antenna circuit 440 are of a larger length than the third antenna circuit 530. The first antenna circuit 430, first conductive hole 450, second antenna circuit 440, second conductive hole 520 and third antenna circuit 530 together form a pseudo helical structure. In this embodiment, the antenna device 400 is analogous to a helix antenna which runs two and a fourth circles.

Figure 5A:
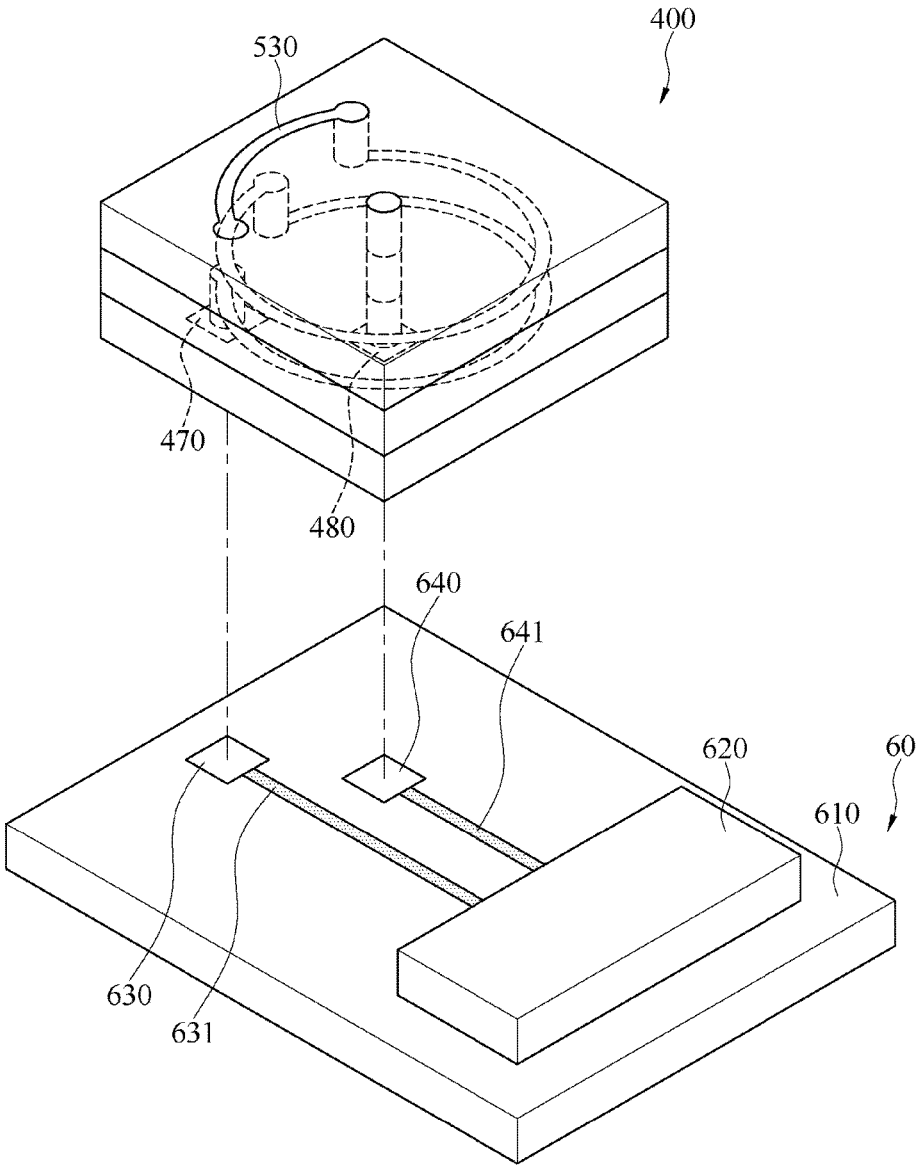
FIG. 5A is an exploded view of an antenna module according to the fifth embodiment of the present invention.
Figure 5B:
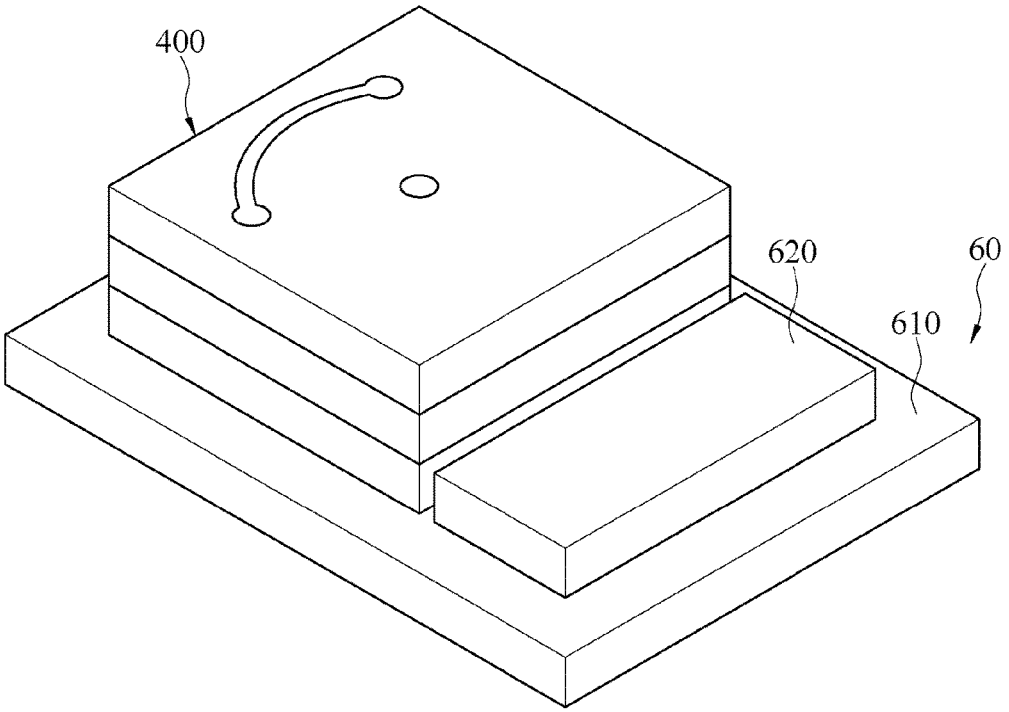
FIG. 5B is a schematic view of the antenna module according to the fifth embodiment of the present invention.

Referring to FIG. 5A and FIG. 5B, FIG. 5A is an exploded view of an antenna module 60 according to the fifth embodiment of the present invention, and FIG. 5B is a schematic view of the antenna module 60 according to the fifth embodiment of the present invention. The antenna module 60 comprises a substrate 610, signal output circuit 620, substrate signal contact 630, substrate ground contact 640 and antenna device 400. The antenna device 400 in the fifth embodiment is the antenna device 400 shown in FIG. 4 and illustrated with the fourth embodiment, but the present invention is not limited thereto. The signal output circuit 620 is disposed on the substrate 610. Both the substrate signal contact 630 and the substrate ground contact 640 are also disposed on the substrate 610. The substrate signal contact 630 is electrically connected to a related circuit in the signal output circuit 620 through a substrate circuit 631 on the substrate 610. The substrate ground contact 640 is electrically connected to a related circuit in the signal output circuit 620 through a substrate circuit 641 on the substrate 610. The substrate signal contact 630 and the substrate ground contact 640 are each a bonding pad for use in carrying out the SMT process.

A process of assembling the antenna module 60 entails performing a manufacturing process of the antenna device 400 and a manufacturing process of the substrate 610, signal output circuit 620, substrate signal contact 630, substrate ground contact 640 and substrate circuits 631, 641, then, as shown in FIG. 5A, aligning the signal contact 470 and the ground contact 480 of the antenna device 400 with the substrate signal contact 630 and the substrate ground contact 640 of the substrate 610, respectively, and eventually connecting the signal contact 470 and the ground contact 480 to the substrate signal contact 630 and the substrate ground contact 640 by the SMT process, respectively, as shown in FIG. 5B. In this embodiment, the assembly process of the antenna module 60 is convenient and quick. Referring to FIG. 4, FIG. 5A and FIG. 5B, upon completion of the assembly of the antenna module 60, the first antenna circuit 430 of the antenna device 400 is electrically connected to the substrate signal contact 630, whereas the conductive ground hole 420 of the antenna device 400 is electrically connected to the substrate ground contact 640. The third antenna circuit 530, second conductive hole 520, second antenna circuit 440, first conductive hole 450, first antenna circuit 430, base conductive hole 490 and signal contact 470 form an electrical loop with the related circuits of the substrate signal contact 630, substrate circuit 631 and signal output circuit 620. The conductive ground hole 420 and ground contact 480 form an electrical loop with the related circuits of the substrate ground contact 640, substrate circuit 641 and signal output circuit 620. In this embodiment, the top end 421 of the conductive ground hole 420 is positioned distal to the ground contact 480 to function as an open end, whereas the second end 532 of the third antenna circuit 530 also functions as an open end. Therefore, the top end 421 of the conductive ground hole 420 and the second end 532 of the third antenna circuit 530 are not electrically connected to any other circuit or component.

The antenna module 60 is disposed in an electronic device, such as a GPS navigator, and adapted to receive and transmit a GPS signal, but the present invention is not limited thereto. The antenna module 60 not only receives the GPS signal through the antenna device 400 but also transmits the received GPS signal to a related processing module disposed inside the electronic device through the signal output circuit 620 for further use. In a variant embodiment, the signal contact 470, ground contact 480, substrate signal contact 630 and substrate ground contact 640 are dispensable, and in consequence, for example, the substrate 610 and the antenna device 400 are directly manufactured by multilayer-board and multilayer-circuit manufacturing techniques of printed circuit boards. In this situation, the conductive circuits disposed in the conductive ground hole 420 and the base conductive hole 490 are electrically connected to a related circuit of the signal output circuit 620 of the substrate 610. Moreover, the signal output circuit 620 is disposed on a surface of the substrate 610, wherein the surface of the substrate 610 faces away from the antenna device 400. Alternatively, the signal output circuit 620 is disposed on a multilayer board disposed inside the substrate 610. The antenna device 100, antenna device 200, antenna device 300 and antenna device 400 are manufactured by multilayer-board and multilayer-circuit manufacturing techniques of printed circuit boards to simplify antenna manufacturing and assembly and cut costs.

Although the present invention is disclosed above by preferred embodiments, the preferred embodiments are not restrictive of the present invention. Any persons skilled in the art can make some changes and modifications to the preferred embodiments without departing from the spirit and scope of the present invention. Accordingly, the legal protection for the present invention should be defined by the appended claims.

What is claimed is:

1. An antenna device, comprising:

a first medium layer;

a conductive ground hole penetrating the first medium layer;

a first antenna circuit disposed on a first surface of the first medium layer to partially encircle the conductive ground hole;

a second antenna circuit disposed on a second surface of the first medium layer opposite the first surface and positioned distal to the first antenna circuit to partially encircle the conductive ground hole; and a first conductive hole penetrating the first medium layer, having an end electrically connected to a second end of the first antenna circuit, and having another end electrically connected to a first end of the second antenna circuit;

wherein the conductive ground hole is a hollow cylinder having openings disposed on each of the second surface of the first medium layer and the first surface of the first medium layer.

2. The antenna device of claim 1, wherein the first antenna circuit and the second antenna circuit overlap on a projection plane perpendicular to a direction in which the conductive ground hole extends.

3. The antenna device of claim 1, wherein a first end of the first antenna circuit and the first end of the second antenna circuit are dislocated from each other.

4. The antenna device of claim 1, wherein the first conductive hole and the conductive ground hole are parallel to each other.

5. The antenna device of claim 1, wherein the first antenna circuit, the first conductive hole and the second antenna circuit together form a pseudo helical structure, such that the first antenna circuit and the second antenna circuit lie on different planes and are connected by the first conductive hole to form a continuous looping structure.

6. The antenna device of claim 1, wherein the first antenna circuit is of a same length as the second antenna circuit.

7. The antenna device of claim 1, wherein the first antenna circuit is of a larger length than the second antenna circuit.

8. The antenna device of claim 1, further comprising:

a base medium layer disposed on the first surface of the first medium layer, with the first antenna circuit sandwiched between the first medium layer and the base medium layer, wherein the conductive ground hole penetrates the base medium layer;

a signal contact and a ground contact, both disposed on a surface of the base medium layer which is positioned distal to the first medium layer, wherein the conductive ground hole has an end electrically connected to the ground contact; and a base conductive hole penetrating the base medium layer, having an end electrically connected to the signal contact, and having another end electrically connected to a first end of the first antenna circuit.

9. The antenna device of claim 8, wherein another end of the conductive ground hole faces away from the ground contact to function as an open end.

10. The antenna device of claim 8, wherein a second end of the second antenna circuit functions as an open end.

11. The antenna device of claim 1, further comprising:

a second medium layer disposed on the second surface of the first medium layer, with the second antenna circuit sandwiched between the first medium layer and the second medium layer, wherein the conductive ground hole penetrates the second medium layer;

a third antenna circuit disposed on a surface of the second medium layer which is positioned distal to the second antenna circuit to partially encircle the conductive ground hole; and a second conductive hole penetrating the second medium layer, having an end electrically connected to a second end of the second antenna circuit, and having another end electrically connected to a first end of the third antenna circuit.

12. An antenna module, comprising:

a substrate;

a signal output circuit disposed on the substrate;

a substrate signal contact and a substrate ground contact, both disposed on the substrate and electrically connected to the signal output circuit; and the antenna device recited in claim 1 and disposed on the substrate, wherein the first antenna circuit is electrically connected to the substrate signal contact, and the conductive ground hole is electrically connected to the substrate ground contact.

13. The antenna module of claim 12, wherein the first antenna circuit and the second antenna circuit overlap on a projection plane perpendicular to a direction in which the conductive ground hole extends.

14. The antenna module of claim 12, wherein a first end of the first antenna circuit and the first end of the second antenna circuit are dislocated from each other.

15. The antenna module of claim 12, wherein the first conductive hole and the conductive ground hole are parallel to each other.

16. The antenna module of claim 12, wherein the first antenna circuit, the first conductive hole and the second antenna circuit together form a pseudo helical structure, such that the first antenna circuit and the second antenna circuit lie on different planes and are connected by the first conductive hole to form a continuous looping structure.

17. The antenna module of claim 12, wherein the antenna device further comprises:

a base medium layer disposed on the first surface of the first medium layer, with the first antenna circuit sandwiched between the first medium layer and the base medium layer, wherein the conductive ground hole penetrates the base medium layer;

a signal contact and a ground contact, both disposed on a surface of the base medium layer which is positioned distal to the first medium layer, wherein the conductive ground hole has an end electrically connected to the ground contact; and a base conductive hole penetrating the base medium layer, having an end electrically connected to the signal contact, and having another end electrically connected to a first end of the first antenna circuit, wherein the signal contact is electrically connected to the substrate signal contact, and the ground contact is electrically connected to the substrate ground contact.

18. The antenna module of claim 17, wherein another end of the conductive ground hole faces away from the ground contact to function as an open end, and a second end of the second antenna circuit functions as an open end.

19. The antenna module of claim 12, wherein the antenna device further comprises:

a second medium layer disposed on the second surface of the first medium layer, with the second antenna circuit sandwiched between the first medium layer and the second medium layer, wherein the conductive ground hole penetrates the second medium layer;

a third antenna circuit disposed on a surface of the second medium layer which is positioned distal to the second antenna circuit to partially encircle the conductive ground hole; and a second conductive hole penetrating the second medium layer, having an end electrically connected to a second end of the second antenna circuit, and having another end electrically connected to a first end of the third antenna circuit.

* * * * *